United States Patent [19]

Connolly

[11] 4,206,846

[45] Jun. 10, 1980

[54] PALLET LOAD WRAPPING WITH STRETCHABLE PLASTIC NETTING

[75] Inventor: Hugh R. Connolly, Minnetonka, Minn.

[73] Assignee: Bemis Company, Inc., Minneapolis, Minn.

[21] Appl. No.: 971,549

[22] Filed: Dec. 20, 1978

Related U.S. Application Data

[63] Continuation-in-part of Ser. No. 840,892, Oct. 11, 1977, Pat. No. 4,136,501.

[51] Int. Cl.[2] ..... B65D 19/00; B65D 75/02

[52] U.S. Cl. ..... 206/597; 53/461; 108/55.1; 229/87 R

[58] Field of Search ..... 206/386, 597, 497; 229/62, 87 R, 53; 108/55.3, 55.1; 53/461, 559; 428/107

[56] References Cited

U.S. PATENT DOCUMENTS

| | | | |
|---|---|---|---|
| 1,447,331 | 3/1923 | Angier et al. | 229/87 R |
| 3,384,530 | 5/1968 | Mercer et al. | 229/53 |
| 3,857,486 | 12/1974 | Klebanoff, Jr. | 108/55.3 |
| 3,945,493 | 3/1976 | Cardinal | 206/497 |

FOREIGN PATENT DOCUMENTS

| | | | |
|---|---|---|---|
| 2207573 | 8/1973 | Fed. Rep. of Germany | 206/497 |

*Primary Examiner*—William T. Dixson, Jr.
*Attorney, Agent, or Firm*—Senniger, Powers, Leavitt and Roedel

[57] ABSTRACT

Plastic netting, particularly for wrapping pallet loads, securely to hold the load on the pallet without heat-shrinking of the netting and providing for ventilation of the load, i.e., egress of air from the load or ingress of air to the load; a method of wrapping the load with such netting for such purpose; and the resultant wrapped pallet load.

8 Claims, 18 Drawing Figures

FIG. 6
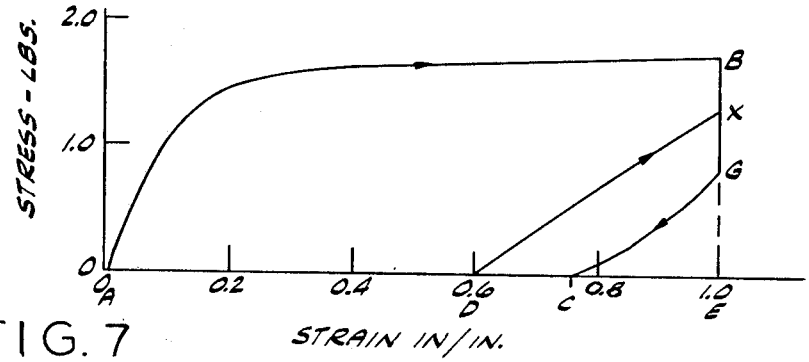
FIG. 7
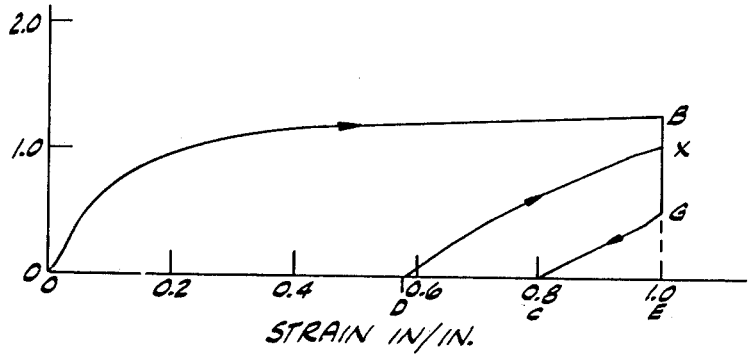
FIG. 8
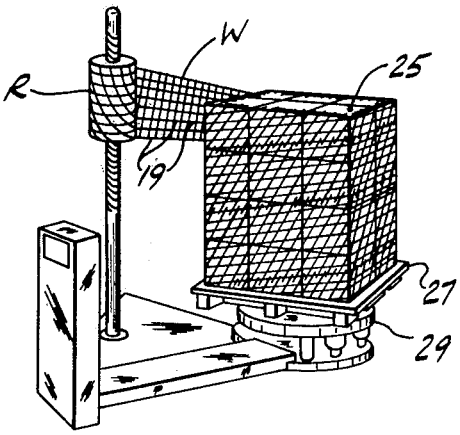
FIG. 9
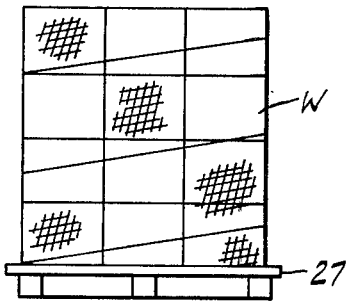
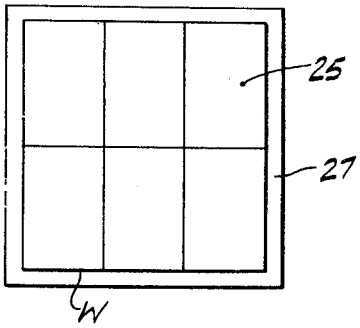
FIG. 10

PALLET LOAD WRAPPING WITH STRETCHABLE PLASTIC NETTING

CROSS-REFERENCE TO RELATED APPLICATION

This application is a continuation-in-part of my copending U.S. Pat. application Ser. No. 840,892, filed Oct. 11, 1977, issued as U.S. Pat. No. 4,136,501 on Jan. 30, 1971.

BACKGROUND OF THE INVENTION

This invention relates to wrapping loads on pallets, more particularly the wrapping of a load such as a stack of filled bags or boxes on a pallet.

Wrapping such pallet loads to stabilize them on the pallet, i.e., to maintain them intact on the pallet, has become widespread practice. Heretofore, various modes of wrapping have been employed for this purpose. One such mode (referred to as stretch wrapping) involves the wrapping of stretchable plastic film around the load, and stretching of the film as disclosed in U.S. Pat. No. 3,867,806, for example. Another mode (referred to as shrink wrapping) involves the wrapping of heat-shrinkable plastic film around the load or the placement of a cover (a bag) of such film as a wrapping over the load, and heating the wrapping as by conveying the pallet with the enwrapped load thereof through an oven (which may be referred to as a shrink tunnel) for heating the wrapping to cause it to shrink on the load. Each of these modes has the distinct disadvantage insofar as many loads are concerned that air cannot circulate through the wrapping. Thus, for example, a load of bags of flour, which bags are palletized in a warm condition, generally cannot be stretch wrapped or shrink wrapped because of condensation of moisture within the wrapping when the bags cool, causing damage to the product. Further by way of example, a load of fresh produce in ventilated packages, the produce requiring ventilation, cannot be stretch or shrink wrapped. A mode of wrapping products utilizing a sleeve of heat-shrinkable plastic netting so as to provide ventilation has been proposed - see U.S. Pat. No. 3,945,493—but this requires heat-shrinking of the sleeve by passing the pallet with the ensleeved load thereon through an oven, and this may damage certain products (e.g., fresh produce) or be dangerous in the case of certain products (e.g., presenting a fire hazard), as in the case of flour. A fourth mode had involved banding the load with steel or plastic strapping. Conventional steel and plastic strapping has very little elasticity and consequently when applied to a pallet load tends to loosen and cease holding the load securely as the load, in the case of flowable product in bags, compacts or, in the case of wet produce in corrugated cardboard cartons, the carton walls weaken and collapse. While both the heat-shrunk netting and strapping provide for air circulation, they do not hold many pallet loads securely through the numerous handlings the pallet may receive.

SUMMARY OF THE INVENTION

Among the several objects of this invention may be noted the provision of a method of wrapping a pallet load to hold the load substantially intact on the pallet with the load adequately ventilated (for egress of air from the load and ingress of air to the load), without requiring any heat-shrinking operation so that the method is safe and convenient to use; the provision of a wrapped pallet load with the load being adequately ventilated while at the same time being securely wrapped to hold it substantially intact on the pallet without heat-shrinking; and the provision of such method enabling economical, safe ventilated wrapping of a pallet load, and the resultant enwrapped load.

In general, the method of this invention of stabilizing a load on a pallet or the like comprises wrapping a continuous web of plastic netting around the load, the web of netting having strands extending generally longitudinally of the web spaced at intervals transversely of the web and strands extending generally transversely of the web spaced at intervals longitudinally of the web, the netting being formed of a thermoplastic synthetic resin material, the longitudinal and transverse strands being integrally joined at the intersections thereof, the longitudinal strands being elastic so as to be stretchable and capable of retaining a substantial degree of their elasticity over a relatively long period of time, the web of netting being wound around the load with the longitudinal strands of the web of netting extending in the direction of winding and, as the web of netting is wound around the load, stretching the longitudinal strands of the web of netting, and securing the web of netting in place on the load with the longitudinal strands so stretched, thereby to bind the load, the netting allowing for ventilation of the load.

A pallet load of this invention is a load wrapped with a continuous web of plastic netting, the web of netting having strands extending generally longitudinally of the web spaced at intervals transversely of the web and strands extending generally transversely of the web spaced at intervals longitudinally of the web, the netting being formed of a thermoplastic synthetic resin material, the longitudinal and transverse strands being integrally joined at the intersections thereof, the longitudinal strands being elastic so as to be stretchable and capable of retaining a substantial degree of their elasticity over a relatively long period of time, the web of netting being wound around the load with the longitudinal strands of the web of netting extending in the direction of winding and stretched to bind the load, the netting allowing for ventilation of the load.

Other objects and features will be in part apparent and in part pointed out hereinafter.

BRIEF DESCRIPTION OF THE DRAWINGS

FIGS. 4–7 are stress-strain charts showing stress retention and tensile strain recovery characteristics of a longitudinal strand of each of four different synthetic resin materials extruded to form the netting;

FIG. 8 is a perspective showing the wrapping of a load on a pallet with plastic netting of this invention;

FIG. 9 is a side elevation of the wrapped pallet load;

FIG. 10 is a plan of FIG. 9;

Corresponding reference characters indicate corresponding parts throughout the several views of the drawings.

DESCRIPTION OF THE PREFERRED EMBODIMENTS

Figure 1:
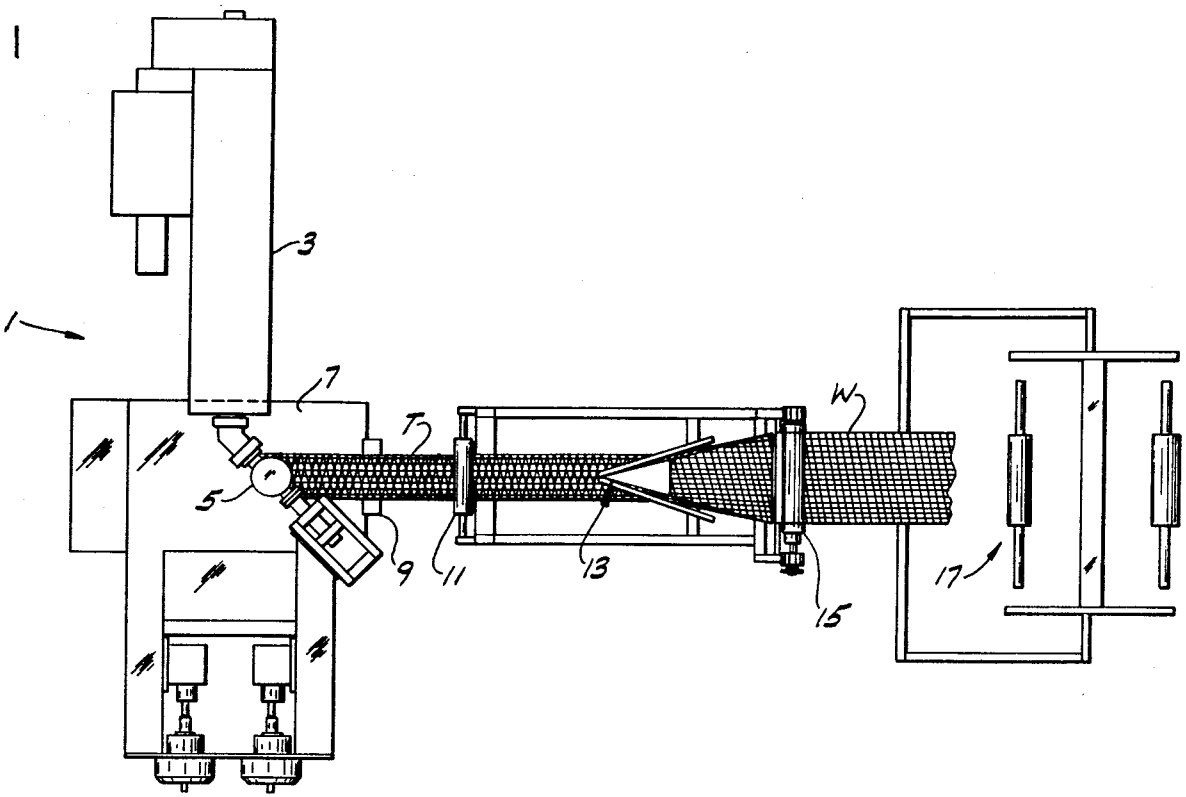
FIG. 1 is a plan of apparatus for extruding plastic netting of this invention, showing the netting extruded in the form of a tube, and the tube slit longitudinally and opened up to form a web.

Referring to the drawings, first to FIG. 1, there is generally indicated at 1 apparatus for extruding plastic netting in the form of a tube with the netting having strands extending generally longitudinally of the tube and strands extending circumferentially of the tube. This apparatus, which may correspond generally to the netting extrusion apparatus shown in U.S. Pat. No. 2,919,467 and 3,089,804, basically comprises an extruder 3 comprising a heated barrel having an extruder screw rotatable therein, for heating a thermoplastic synthetic resin material to a plastic state and feeding the resin in that state out through one end of the barrel to and through a set of netting extrusion dies 5. The latter function to extrude netting in the form of a tube with this netting having the stated longitudinal and circumferential strands, these strands being integrally joined at the intersections thereof. The tube is extruded downwardly into a water bath 7 for quenching (cooling) it, and is then flattened between a pair of draw rolls in the bath. The flattened tubing, which is indicated at T in FIG. 1, is pulled out of the bath over a guide roll 9, fed through a pair of guide rolls indicated at 11, longitudinally slit by a slitter at 13 and opened up into a flat web W of the netting. The flat web passes through a set of draw rolls 15, which draw the web W and tube T forward, and is wound on a core, e.g., a cardboard core, in a winder indicated generally at 17.

The set of netting extrusion dies 5 comprises an inner die and an outer die as in U.S. Pat. Nos. 2,919,467 and 3,089,804, with the outer die continuously rotatable and the inner die stationary as described in U.S. Pat. No. 2,919,467 (column 7, lines 43–45), so that the extruded tube T of netting has longitudinal strands and circumferential strands extending helically of the tube.

Figure 2:
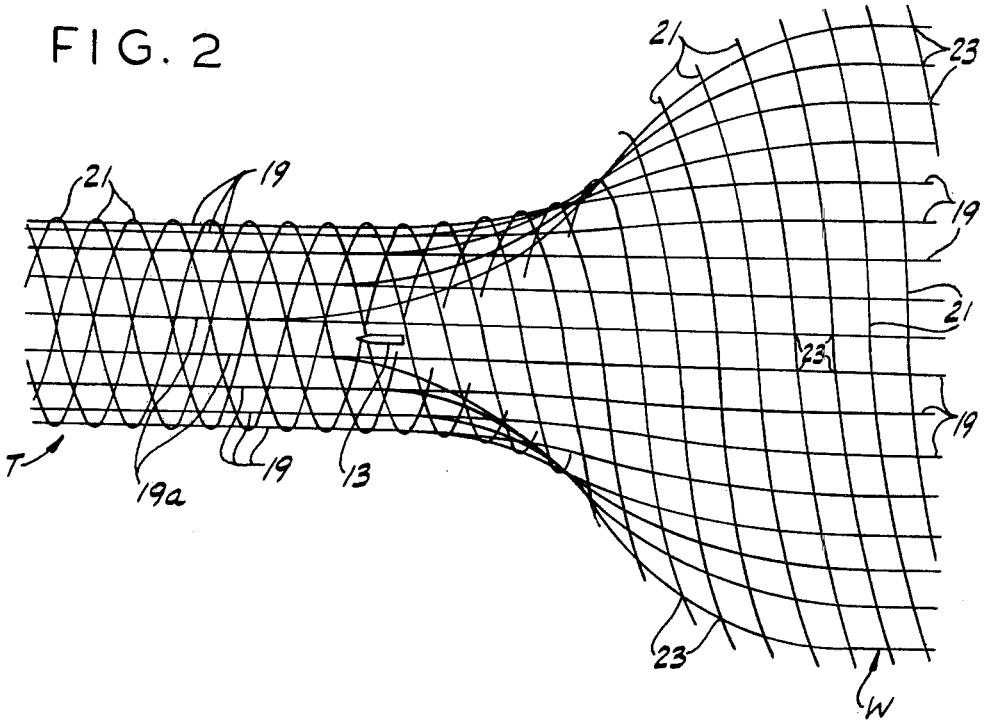
FIG. 2 is a view on a larger scale than FIG. 1 showing the slitting and opening up of the tube to form a web of plastic netting of this invention.

FIG. 2 shows the tube T, the slitter 13, and the flat continuous web W into which the tube is slit on a larger scale than FIG. 1. The longitudinal strands of the tube are designated 19. These become longitudinal strands of the web, extending generally longitudinally of the web spaced at intervals transversely of the web. The circumferential strands of the tube are designated 21. They become transverse strands of the web, extending generally transversely of the web spaced at intervals longitudinally of the web. In the tube and in the web, the longitudinal strands 19 and the transverse strands 21 are integrally joined at the intersections 23 thereof.

The longitudinal strands 19 of the web are elastic so as to be stretchable and capable of retaining a substantial degree of elasticity over a relatively long period of time. It is preferred that they be stretchable to the extent of retaining at least 30% of the initial stress having a tensile strain recovery of at least 10% as determined by an adaptation of the ASTM Standard Method of Test for Elastic Properties of Textile Fibers No. D1774-72.

Since the transverse strands 21 are formed in the extrusion process of the same thermoplastic synthetic resin material as the longitudinal strands, the transverse strands will generally have the same stretchability characteristic and tensile strain recovery characteristic as the longitudinal strands. The stretchability and tensile strain recovery characteristics of the longitudinal strands are important for effectively stabilizing a load on a pallet through the numerous handlings the pallet with the load thereon may receive.

The netting may be formed of any thermoplastic synthetic resin material which is extrudable to form netting and which will provide the requisite stretchability and tensile strain recovery characteristics as specified above. It may be extruded of such polyolefins as will provide these characteristics. The material may be a single polyolefin or a blend of polyolefins. The presently preferred material for the netting is a blend of about 90% polybutylene and 10% polypropylene by weight. Other proportions may be suitable. Another suitable blend of polyolefins is a blend of low density polyethylene and high density polyethylene, preferably about 75%/25% by weight. A blend of ethylene vinyl acetate and polypropylene, preferably about 90%/10% by weight, or ethylene vinyl acetate per se may be used. Other possible materials are polybutylene per se, low density polyethylene per se, ethylene acrylic acid copolymers, and a blend of ethylene vinyl acetate with high density polyethylene.

In the web W, the diameter of the strands (both the longitudinal and transverse strands) may range from about 0.010 inch to about 1.100 inch. The transverse strands may be of smaller diameter than the longitudinal strands, their principal functions being as bridging connections between the longitudinal strands and providing a vertical restraint to the pallet load when the load is subject to vertical movement as in the case of bouncing or vibrating in the course of transporting on a truck or rail car. In this respect, the diameter of the transverse strands may be reduced as much as about 50%, for example, of the diameter of the longitudinal strands. Preferred ranges are about 0.030–0.050 inch in diameter for the longitudinal strands and 0.020–0.050 inch for the transverse strands. The width of the web may range generally from about 6 inches to about 70 inches. The spacing ofthe longitudinal strands transversely of the web may range from about ½ inch to about 10 inches, and the spacing of the transverse strands longitudinally of the web may range from about ¼ inch to about 10 inches. For example, the web W may be 20 inches wide, with 17 longitudinal strands spaced at 17/20 inch intervals, and with the transverse strands spaced at 1¾ inch intervals. The longitudinal strands may be about 0.034–0.037 inch in diameter and the transverse strands may be about 0.025 inch in diameter.

In the web W as shown in FIG. 2, the transverse strands, having been derived as circumferential strands of the tube T, are not at 90° to the longitudinal strands, but are angled slightly off 90°. However, it is contemplated that the angle of the transverse strands to the longitudinal strands may range from 90° to 45°.

The following examples illustrate the invention.

EXAMPLE 1

A blended mixture consisting of 90% polybutylene and 10% polypropylene by weight was extruded via the extruder 3 and the set of dies 5 corresponding to the extruder and set of dies shown in U.S. Pat. No. 2,919,467. The inner die of the set (corresponding to the die member 12 shown in U.S. Pat. No. 2,919,467) was held stationary for the extrusion of the longitudinal strands in the longitudinal direction of the tube T of netting (sometimes also referred to as the "machine direction"). The inner die diameter was 3¾ inches, and it had 17 extrusion grooves (corresponding to grooves 14 of U.S. Pat. No. 2,919,467) spaced around its periphery at generally equal intervals so that the tube of netting was extruded with 17 longitudinal strands on a 3¾ inch tube diameter. The hauloff speed for the tubing, as determined by the speed of the draw rolls 15, was 20 feet per minute, and the outer die of the set (corresponding to the die member 6 shown in U.S. Pat. No. 2,919,467) was rotated around the inner die at 30 rpm. It had 17 extrusion grooves corresponding to the inner die. The 3¾ inch diameter tubing issuing from the dies passed downwardly over a mandrel 6¼ inches in diameter, (similar to mandrel 21*a* shown in U.S. Pat. No. 3,089,804) thereby expanding the 3¾ inch diameter tubing to 6¼ inch diameter tubing via stretching (while still in plastic condition) of the transverse strands. The extrusion grooves in the inner and outer dies were such that the longitudinal strands and transverse strands issuing therefrom were about 0.034–0.037 inch in diameter, the transverse strands being stretched and thinned on account of the passage over the mandrel to about 0.025 inch in diameter. The slitter 13 was positioned to extend between two adjacent longitudinal strands 19, these being specially designated 19*a* in FIG. 2, so as to cut through the transverse strands 21 between these two longitudinal strands 19*a* as the netting traveled forward (toward the right as illustrated in FIGS. 1 and 2) from the rolls 11 to the draw rolls 15. Following the slitting at 13, the tube was opened up to form the web W which, after passing through the draw rolls 15, was wound up on a core in the winder 17, the latter being traversed axially back and forth for traverse winding of the web W, the purpose of the traverse being to distribute the longitudinal strands axially one way and the other with respect to the core so that they did not wind up convolutely.

The web W formed as above described was 20 inches wide, having 17 longitudinal strands spaced at 17/20 inch intervals, and transverse strands spaced generally at 1¾ inch intervals. The longitudinal strands were about 0.034–0.037 inch in diameter and the transverse strands were about 0.025 inch in diameter. The process as described produced 67 lineal feet of the 20 inch wide web per pound of the 90% polybutylene/10% polypropylene material.

Figure 4:
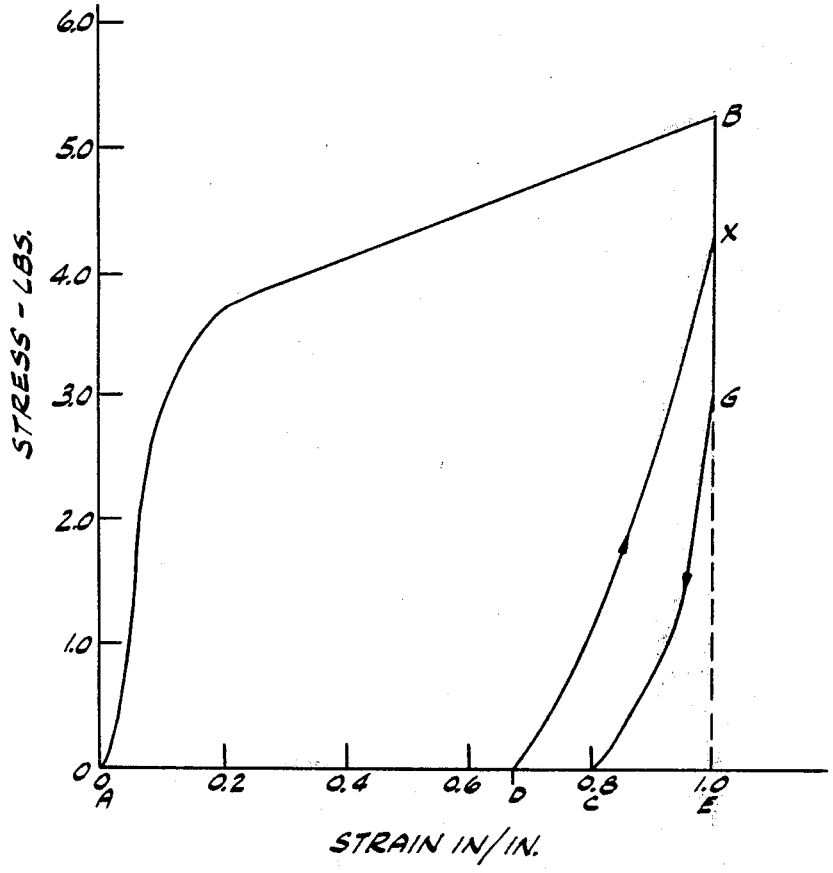

A length of a longitudinal strand 19 of the 90% polybutylene/10% polypropylene material was tested according to an adaptation of the ASTM Standard Method of Test for Elastic Properties of Textile Fibers No. D1774-72, the test results being plotted on the chart shown in FIG. 4 (the form of this chart corresponding to the chart shown in FIG. 1 of the ASTM publication No. D1774-72), wherein the horizontal coordinate represents the strain (inches of stretch of the test specimen per inch length of the specimen) and the vertical coordinate represents the pounds of stress in the test specimen at the various amounts of strain. In carrying out the test, the test specimen (which had a total length of about 5 inches) was clamped in the jaws of the testing machine with the jaws 2 inches apart so that the effective length of the specimen under test was 2 inches. Then the jaws were relatively extended to stretch the specimen at the rate of 1000% per minute and the stretching was continued until the specimen had been extended 100% to 4inches. The stress/strain relationship for this phase of the test is represented by the line A–B on the chart, showing a stress in the specimen of about 5.25 lbs. at 100% stretch (at point B). The specimen was held at 100% stretch for sixteen hours, during which time the stress relaxed from point B to point G on the chart, point G being at 2.95 lbs. Then, in accordance with the ASTM Test No. D1774-72, the jaws of the testing machine were allowed to return to their initial separation (i.e., 2 inches), the stress/strain relationship for this phase of the test being represented by the line G–C on the chart. This shows that the length of the specimen decreased from its 4 inch stretched length to a length of about 0.8 of its stretched length, which is about 3.2 inches. The specimen was then allowed to rest at zero stress for one minute, and then the jaws were again extended to again stretch the specimen at the rate of 1000% per minute back to the 4 inch length, the stress/strain relationship for this phase of the test being represented by the line A–D–X, showing that the stress remained at zero until the jaws reached point D, which is at about 0.68 inch on the chart, and then rose to about 4.30 lbs. at point X where the specimen reached the 4 inch stretched length.

On the chart, E denotes the point of one inch strain per one inch of initial jaw separation. The stress retention characteristic of the strand of the 90% polybutylene/10% polypropylene material then is the ratio of the length of the line G–E, which is the stress in the specimen after the sixteen hour relaxation period, to the length of the line B–E which is the stress in the specimen at 100% stretch before the sixteen hour relaxation period, and this is 2.95/5.25=0.562 or 56.2%. The tensile strain recovery of the strand is the ratio of the length of line D–E to the length of line A–E, and this is 0.32/1=0.32 or 32%.

Thus, the longitudinal strands 19 of the netting extruded from the 90% polybutylene/10% polypropylene thermoplastic synthetic resin material, when stretched at least 100% at the rate of 1000% per minute, retained a substantial degree of elasticity over a relatively long period of time (sixteen hours); having a stress retention factor of 56.2% and a tensile strain recovery of 32%.

EXAMPLE 2

A blended mixture consisting of 75% low density polyethylene and 25% high density polyethylene was extruded to form netting as in Example 1.

Figure 5:
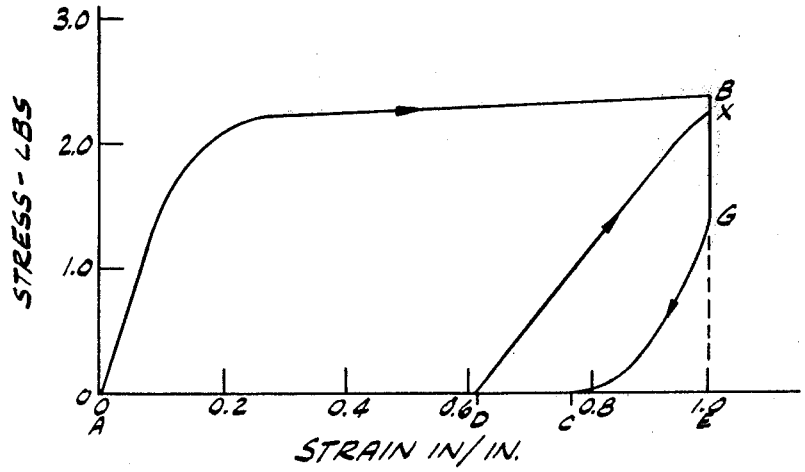

A length of a longitudinal strand 19 of the Example 2 netting was tested in the same manner as specified in Example 1, and the results of the test on the 75% low density polyethylene/25% high density polyethylene material of Example 2 are plotted on the chart of FIG. 5. As appears from this chart, the longitudinal strands of the Example 2 netting, when stretched at least 100% at the rate of 1000% per minute, had a stress retention factor of 60% and a tensile strain recovery of 39% in the test with a 16 hour relaxation period.

EXAMPLE 3

A blended mixture consisting of 90% ethylene vinyl acetate and 10% polypropylene was extruded to form netting as in Example 1.

A length of a longitudinal strand 19 of the Example 3 netting was tested in the same manner as specified in Example 1, and the results of the test on the 90% ethylene vinyl acetate/10% polypropylene material of Example 3 are plotted on the chart of FIG. 6. As appears from this chart, the longitudinal strands of the Example 3 netting, when stretched at least 100% at the rate of 1000% per minute, had a stress retention factor of 48% and a tensile strain recovery of 40% in the test with a 16 hour relaxation period.

EXAMPLE 4

100% ethylene vinyl acetate was extruded to form netting as in Example 1.

A length of a longitudinal strand 19 of the Example 4 netting was tested in the same manner as specified in Example 1, and the results of the test on the 100% ethylene vinyl acetate material of Example 4 are plotted on the chart of FIG. 7. As appears from this chart, the longitudinal strands of the Example 4 netting, when stretched at least 100% at the rate of 1000% per minute, had a stress retention factor of 40% and a tensile strain recovery of 42% in the test with a 16 hour relaxation period.

EXAMPLE 5

A blended mixture consisting by weight of 90 parts polybutylene, 10 parts polypropylene, and ½ part color concentrate, more particularly the color concentrate sold under the trade designation Ampacet Green 17213 by Ampacet Corporation, Mount Vernon, New York was extruded similarly to the extrusion described in Example 1 using a different extruder from Example 1 producing netting with the following characteristics:

| | |
|---|---|
| Basis weight (yield) | Approximately 15,500 square inches per pound of mixture |
| Thickness of Machine Direction Strands | 0.045" nominal |
| Thickness of Transverse Direction Strands | 0.042" nominal |
| Width of Web | Approximately 20" |
| Number of Machine Direction Strands | 16 |
| Spacing of Transverse Direction Strands | 2 ⅜" ± ⅛" |

The extruded netting was stored at room conditions for a minimum of seven days before use.

Referring to FIG. 8, a continuous web W of the plastic netting is shown being wrapped around a load 25 on a pallet 27 for stabilizing the load on the pallet. The wrapping is carried out by means of any suitable pallet wrapping machine a number of which are on the market for stretch wrapping pallet loads (with stretch film). Generally, such a machine comprises a turntable 29 on which the loaded pallet is placed, this turntable being adapted for rotation with the loaded pallet thereon for wrapping around the load a web pulled from a supply roll R. As shown in FIG. 8, the web is one that is relatively narrow in relation to the height of the load and the machine includes means for traversing the roll R for spirally wrapping the web around the load. Braking means is provided for braking the roll R to tension the web thereby to stretch it as it is wound around the load. So-called spiral stretch wrap machines of this type include the Arenco Automatic Spiral Stretch Wrap Machine sold by Arenco Machine Co., Inc. of Teterboro, New Jersey, the Spiral LANRAPR Machine sold by Lantech, Inc. of Louisville, Kentucky, and the SIDEWINDER or the AVENGER Spiral Stretch-Wrap Machines of Infra Pak (Dallas) Inc. of Dallas, Texas.

The continuous web W of netting shown in FIG. 8 is, for example, a 20 inch wide web as described above. For wrapping it around the pallet load 25, the leading edge of the web of netting is suitably secured to the load, as by bunching it and inserting it between individual items of the load, or between the load and the top surface of the pallet, the pallet is rotated and the roll R traversed for spirally wrapping the netting around the load. As the web of netting is being wrapped, the roll R is braked so that the wrapping is carried out with the netting under such tension that the longitudinal strands 19 of the netting, which extend in the direction of wrap, are stretched to the desired degree, which may be in the range from 25% to 200%. On completion of the wrapping, the netting is secured in place on the load as by stapling or otherwise fastening it to itself and cutting it between the roll R and the load. Alternatively, the netting may be cut and its cut end bunched and threaded through an interstice of the netting with or without tying, for securing it in place. In securing the netting in place, the stretch of the longitudinal strands is preserved.

In a typical wrapping operation, utilizing an Infra Pak SIDEWINDER machine, a load 48 inches wide and 50 inches high on a pallet was wrapped with the netting of Example 1, with a tension setting of 50 on the machine, providing an elongation of about 110% of the longitudinal strands 19 of the netting. The wrapping involved taking about 7–7¼ turns around the load, 2 at the base of the load, then spiralling upward about 1½ turns, then taking 2 at the top, and spiralling down about 1½ turns. The operation started with a roll R about 10 inches in diameter wound on a 3 inch core, weighing about 12–13 lbs., containing about 800–820 feet of netting. This was provided for wrapping 15 loads, with about 7–7¼ wraps per load, i.e., 53–55 feet of netting per load, stretched to about 116 feet per load. This amounted to about 0.88 lbs. of netting per load.

In another wrapping operation, the tension setting of the machine was changed to 60, providing an elongation of 150% of the longitudinal strands of the netting, and wrapping of each load with about 0.67 lbs. of netting in contrast to the 0.88 lbs. per load with 110% stretch.

FIGS. 9 and 10 illustrate the enwrapped load, in which longitudinal strands 19 of the web of netting, extending in the direction of wrap spirally around the load, are stretched at least 25%. They thereby bind the load in place on the pallet, and maintain it bound in place even though the stress in the stretched longitudinal strands may relax over a period of time (e.g., from B to G in 16 hours) and even though the load may tend to shift under the handling it receives.

While as above described the load on the pallet is spirally wrapped with the web of netting (which is 20 inches wide, for example), the netting may be used for the so-called full web type of wrapping wherein the width of the netting would approximate the height of the load, either by wrapping a single full-width web of the netting around the load in the manner disclosed for film in U.S. Pat. No. 3,867,806, or by the dual roll single wrap method in which the pallet load would be passed through a vertical wall of netting formed by two webs of netting from two separate rolls of netting on either side of the infeed conveyor of the dual roll single wrap apparatus.

Figure 3:
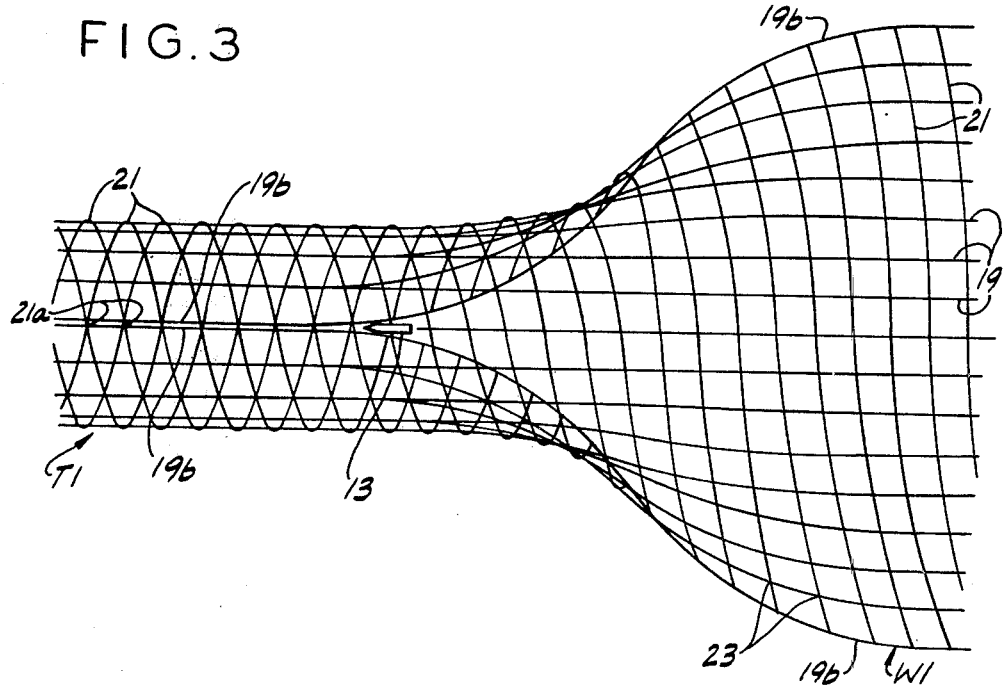
FIG. 3 is a view similar to FIG. 2 showing a modification in the extruded tube.

FIG. 3 illustrates a modification of the extruded net tube, which is designated T1, to have two closely spaced longitudinal strands which are designated **19*b*, the slitter 13 cutting through the short lengths 21*a* of transverse strands between these two closely spaced longitudinal strands. This provides longitudinal strands, more particularly the strands 19***b*, at the side edges of the web formed on opening up the tube, the web in FIG. 3 being designated W1 to distinguish it from the web W. The net tube of FIG. 3 may be extruded in the manner similar to that disclosed in U.S. Pat. No. 3,089,804, by having two closely spaced orifices in the stationary die for extrusion of the two closely spaced longitudinal strands 19*b*.

The netting may be extruded and bias-slit to form it into a web as in U.S. Pat. No. 3,557,268.

It is also contemplated that netting of this invention may be extruded in tubular form by means other than that shown in U.S. Pat. Nos. 2,919,467 and 3,089,804, or in flat form by means such as shown in U.S. Pat. Nos. 2,919,467 (FIGS. 6–8*a*) or in U.S. Pat. Nos. 3,252,181, 3,749,535 and 3,767,353 with stretching of the transverse strands of the netting to make them thinner than the longitudinal strands, if desired.

Figure 11:
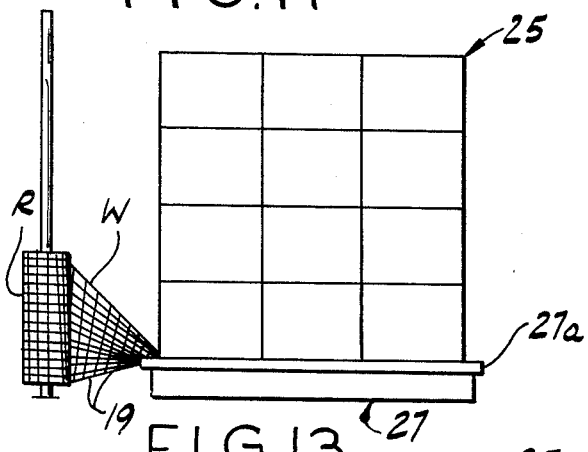
FIGS. 11–17 are additional views showing the wrapping of a load on a pallet with plastic netting.

FIGS. 11–18 illustrate a preferred mode of wrapping a load 25 on a pallet 27 with a web W of the netting, utilizing a spiral stretch wrap machine such as above described and shown in FIG. 8. As shown in FIG. 11, the roll R of netting is lowered for starting the wrapping of the load at the lower end of the load. The web W of netting is unwound from the roll and is suitably secured at its leading end to the load and/or the pallet as, for example, by bunching it into the form of a rope, looping the rope through an opening in the pallet and knotting the rope. Then the pallet is rotated to start wrapping of the web of netting around the load, the roll R being braked so as to tension the netting so that it is stretched. It will be observed that the longitudinal strands 19 of the web of netting extend in the direction of winding, and these strands are stretched as the netting is wound around the load.

Figure 12:
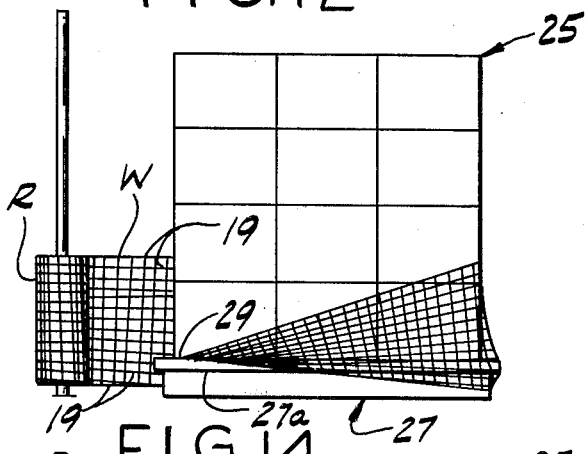
Figure 13:
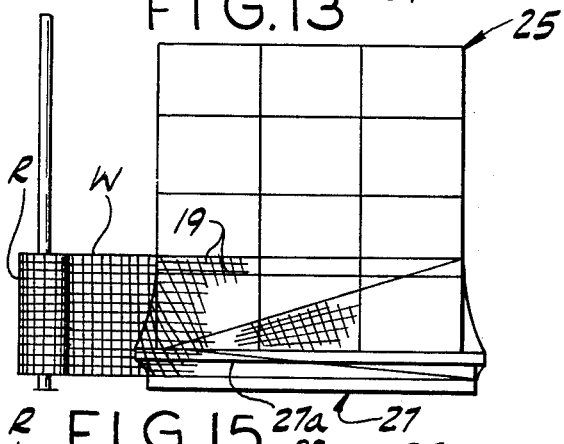
Figure 14:
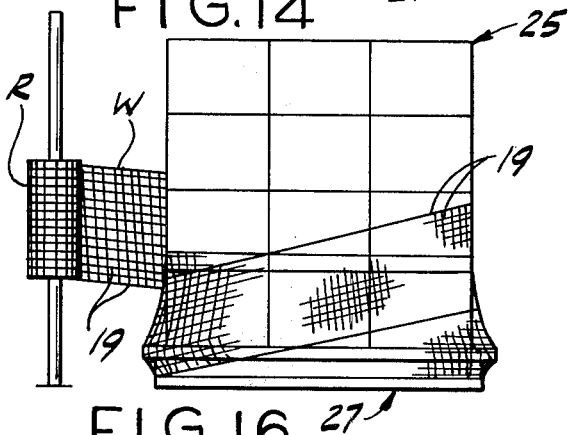
Figure 15:
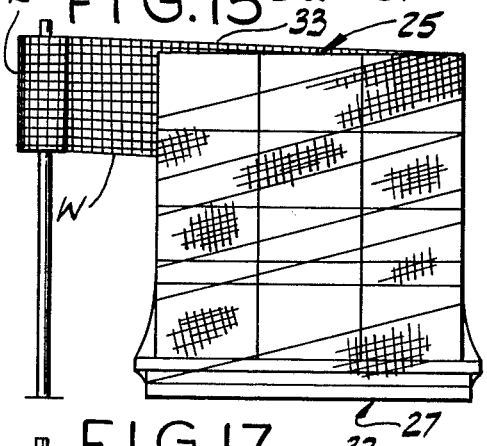
Figure 16:
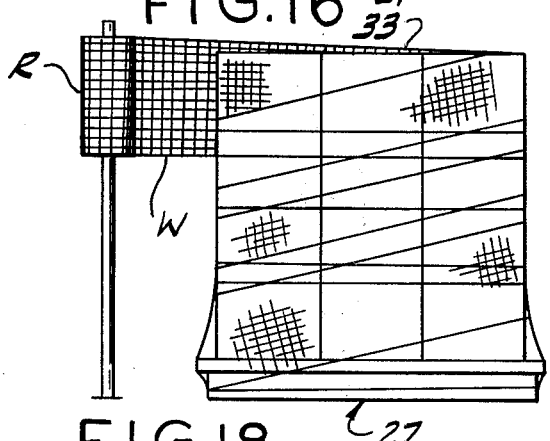
Figure 17:
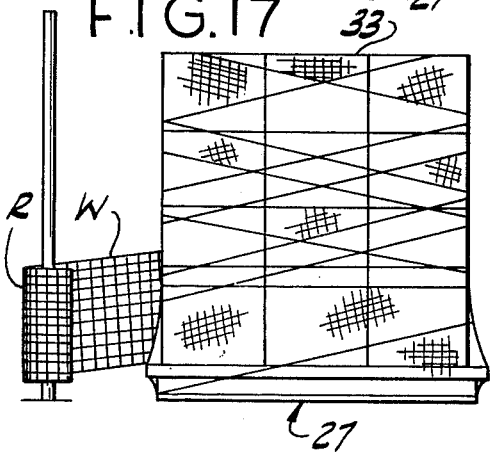
Figure 18:
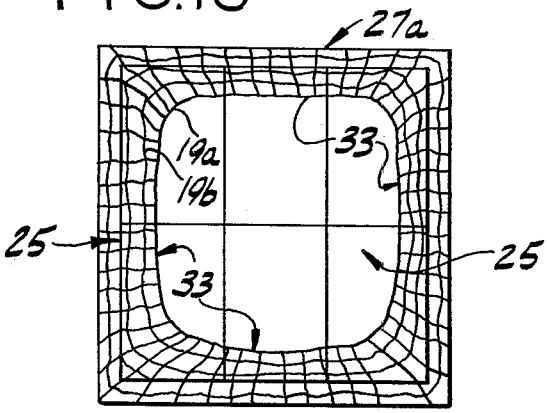
FIG. 18 is a plan of a load on a pallet wrapped as per FIGS. 11–17.

The web of netting is first wrapped (with attendant stretch) around the periphery 27*a* of the pallet and the base of the load (see FIGS. 12 and 13). The point of securement appears at 29 in FIG. 12. After a suitable number of wraps or turns of the netting have been taken around the base of the load and the periphery of the pallet (two turns for example), the roll R is moved upward (see FIG. 14) spirally to wrap the web of netting around the load until the upper end of the roll reaches a level above the top of the load (see FIG. 15). Then, with the roll R maintained at the upper limit of its travel, a suitable number of wraps or turns of the web of netting are taken around the upper part of the load (two turns, for example). The tension in the netting causes the upper margin 33 of the netting to fold or lap over tightly on the top of the load. It is preferred that the roll R be moved up to such an upper limit that there are two of the stretched longitudinal strands such as indicated at 19*a* and 19*b* in FIG. 18 lying on top of the load. Then, the roll R is moved back down further to wrap the netting spirally around the load (see FIG. 17). When the roll has reached its lower limit, a suitable number of turns (two, for example) are taken around the lower part of the load and the periphery of the pallet to complete the wrapping. The turntable is stopped, tension being maintained on the netting, which is bunched into a rope, cut while holding it to maintain the tension, and the end of the netting secured by fastening it with a suitable fastener to the netting surrounding the load, or looping through the netting surrounding the load and knotting it. This completes the operation.

With the netting extending around the periphery 27*a* of the pallet, it laps under the rim of the pallet to some extent as appears in FIGS. 12–17 and the corners of the pallet generally protrude through interstices of the netting to secure the netting to the pallet. The upper margin 33 of the netting, including strands 19*a* and 19*b* under tension, lies over the top of the load in tight engagement therewith, and the upper corners of the load generally protrude through interstices of the netting to bring about a downward binding of the netting on the load.

As herein illustrated, pallet 27 is of the wooden pallet type, comprising a platform or deck on suitable supports. It will be understood that the invention is applicable to a load stacked on a flat rigid sheet of cardboard or plastic material, and it is intended that the term "pallet" have a broad meaning including such sheets.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of stabilizing a load on a pallet or the like comprising unwinding a continuous web of plastic netting from a roll and wrapping it around the load, said web of netting having strands extending generally longitudinally of the web spaced at intervals transversely of the web and strands extending generally transversely of the web spaced at intervals longitudinally of the web, the netting being formed of a thermoplastic synthetic resin material, the longitudinal and transverse strands being integrally joined at the intersections thereof, the longitudinal strands being elastic so as to be stretchable and capable of retaining a substantial degree of their elasticity over a relatively long period of time, said web of netting being wound around the load with the longitudinal strands of the web of netting extending in the direction of winding and, as the web of netting is wound around the load, stretching the longitudinal strands of the web of netting and securing the web of netting in place on the load with the longitudinal strands so stretched, thereby to bind the load, the netting allowing for ventilation of the load.

2. The method of claim 1 wherein the web of netting is wrapped under tension around the load with the margin of the web of netting at the top of the load above the load and whereby said margin folds over on top of the load.

3. The method of claim 2 wherein the web of netting has a width less than the height of the load, is first secured at its leading end to the load or the pallet and wrapped around the base of the load, then traversed upward for spirally wrapping it around the load to a point where the upper margin of the web of netting is above the top of the load, then wrapped around the upper part of the load with accompanying folding over of said upper margin on top of the load, and then traversed downward.

4. The method of any of claims 1, 2 or 3 wherein the spacing of the longitudinal strands is from about ¼ inch to about 10 inches, and the spacing of the transverse strands is from about ¼ inch to about 10 inches.

5. A pallet load wrapped with a continuous web of plastic netting, said web of netting having strands extending generally longitudinally of the web spaced at intervals transversely of the web and strands extending generally transversely of the web spaced at intervals longitudinally of the web, the netting being formed of a thermoplastic synthetic resin material, the longitudinal and transverse strands being integrally joined at the intersections thereof, the longitudinal strands being elastic so as to be stretchable and capable of retaining a substantial degree of their elasticity over a relatively long period of time, said web of netting being wound around the load with the longitudinal strands of the web of netting extending in the direction of winding and stretched to bind the load, the netting allowing for ventilation of the load.

6. A pallet load as set forth in claim 5 wherein the upper margin of the web of netting is folded over on top of the load.

7. A pallet load as set forth in claim 4 wherein the web of netting has a width less than the height of the load, has one end secured to the load or the pallet, is wrapped around the base of the load, is spirally wrapped up to the top of the load, has at least one turn around the upper part of the load with the upper margin of the web of netting folded over on top of the load, and is spirally wrapped back down to the base of the load, with the other end of the web of netting secured in place to hold it stretched around the load and on top of the load.

8. A pallet load as set forth in any of claims 5, 6 or 7 wherein the spacing of the longitudinal strands is from about ¼ inch to about 10 inches, and the spacing of the transverse strands is from about ¼ inch to about 10 inches.

* * * * *

UNITED STATES PATENT AND TRADEMARK OFFICE

CERTIFICATE OF CORRECTION

PATENT NO. : 4,206,846

DATED : June 10, 1980

INVENTOR(S) : Hugh R. Connolly

It is certified that error appears in the above—identified patent and that said Letters Patent is hereby corrected as shown below:

The term of this patent subsequent to January 30, 1996 has been disclaimed.

Signed and Sealed this

*Twenty-sixth* Day of *August 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,206,846

DATED : June 10, 1980

INVENTOR(S) : Hugh R. Connolly

It is certified that error appears in the above-identified patent and that said Letters Patent are hereby corrected as shown below:

Column 1, line 10, "1971" should read -- 1979 --. Column 12, line 1, "4" should read -- 6 --.

Signed and Sealed this

*Twenty-first* Day of *October 1980*

[SEAL]

*Attest:*

SIDNEY A. DIAMOND

*Attesting Officer*

*Commissioner of Patents and Trademarks*